US005484271A

United States Patent [19]

Stich

[11] Patent Number: 5,484,271

[45] Date of Patent: Jan. 16, 1996

[54] COMPACT CONTROLLABLE VANE PUMP

[75] Inventor: Bodo Stich, Wiesbaden, Germany

[73] Assignee: Mercedes-Benz Aktiengesellschaft, Stuttgart, Germany

[21] Appl. No.: 244,601

[22] PCT Filed: Dec. 15, 1992

[86] PCT No.: PCT/DE92/01059

§ 371 Date: Sep. 13, 1994

§ 102(e) Date: Sep. 13, 1994

[87] PCT Pub. No.: WO93/14318

PCT Pub. Date: Jul. 22, 1993

[30] Foreign Application Priority Data

Jan. 9, 1992 [DE] Germany ..... 42 00 305.9

[51] Int. Cl.[6] ..... F01C 21/16

[52] U.S. Cl. ..... 418/26; 418/27; 418/30; 417/220

[58] Field of Search ..... 418/24, 25, 26, 418/27, 30, 31; 417/220

[56] References Cited

U.S. PATENT DOCUMENTS

| | | | |
|---|---|---|---|
| 2,142,275 | 1/1939 | Lane | 418/26 |
| 2,309,148 | 1/1943 | Wilson et al. | 418/26 |
| 2,318,292 | 5/1943 | Chandler | 418/26 |
| 2,894,458 | 7/1959 | Hallman | 418/27 |
| 4,538,974 | 9/1985 | Stich et al. | 418/26 |

FOREIGN PATENT DOCUMENTS

| | | |
|---|---|---|
| 3333647 | 5/1984 | Germany . |
| 4011671 | 10/1991 | Germany . |

*Primary Examiner*—Charles Freay
*Attorney, Agent, or Firm*—Herbert Dubno

[57] ABSTRACT

A vane pump has a casing, a controlling collar guided leaktightly in the casing and movable relative to a rotor mounted in the casing and surrounded by the controlling collar. The movement of the collar is transverse to the axial direction of the rotor. A suction region of the pump is defined by a volume increasing in the direction of rotation of the rotor, of a vane cell formed between two adjacent vanes and decreasing to the pressure region. At least one adjustment member is provided to adjust the position of the controlling collar in dependence on the prevailing pumping parameters. In order to provide a vane pump of space-saving and/or simple and cost-saving design, at least one recess is open towards the outside of the controlling collar and is provided on the controlling collar close to the pressure region to accommodate and adjustment member.

13 Claims, 4 Drawing Sheets

COMPACT CONTROLLABLE VANE PUMP

CROSS REFERENCE TO RELATED APPLICATIONS

This application is a National Phase application of PCT/DE 92/01059 filed 15 Dec. 1992 based, in turn, upon German National Application P 42 00 305.9 of 9 Jan. 1992, under the International Convention.

FIELD OF THE INVENTION

The invention relates to a vane pump comprising a casing, a controlling collar guided leaktightly in the casing and movable relative to a rotor mounted in the casing and surrounded by the controlling collar, the movement being transverse to the axial direction of the rotor, wherein a suction region of the pump is defined by a volume, increasing in the direction of rotation of the rotor, of a vane cell formed between two adjacent vanes, the rotor and the controlling collar, and a pressure region is defined by a volume, decreasing in the direction of rotation, of the vane cell, and wherein at least one adjustment member is provided to adjust the position of the controlling collar in dependence on the prevailing pumping parameters.

The pumping parameters, which influence the position of the controlling collar, can include the delivery volume of the pump, and the pressure at the pressure side.

BACKGROUND OF THE INVENTION

One such vane pump is known from U.S. Pat. No. 2,318,292.

German Offenlegungsschrift No. 40 11 671 also describes a vane pump which has substantially the above mentioned features, but the arrangement and position of possible adjustment members is not described. Apart from the special arrangement of adjustment members and corresponding design of the controlling collar, the vane pump described in DE 40 11 671 Al is identical with the vane pump described in the present application so that that application, which originates from the same inventor, may be referred to as regards further design features and properties associated therewith.

The adjustment members require a large space as is shown by the nearest prior art represented by the above mentioned U.S. Pat. No. 2,318,292. Because such vane pumps are regularly used as auxiliary units for other machines, particularly as lubricating pumps in engines and other machines, the utilization of additional space is undesired and often associated with considerable drawbacks. In addition, also the weight of the pump is thereby increased which is also undesirable. Finally, the control ducts for the adjustment member or members require additional holes or passages in the casing to enable the mentioned pumping parameters to act on the adjustment members which, in turn, change the position of the controlling collar and thereby the parameter of the pump to a desired value.

OBJECT OF THE INVENTION

The object of the present invention is to provide a vane pump with the initially mentioned features which has a space-saving and/or simple and cost-saving construction.

SUMMARY OF THE INVENTION

The object is achieved, in accordance with the invention in that at least one recess, open towards the outside of the controlling collar and in the controlling direction, is provided on the controlling collar close to its pressure region to accommodate an adjustment member.

The adjustment member can therefore be integrated into the controlling collar itself or the recess provided thereon, and needs no additional space, or only small additional space in the casing outside the controlling collar.

A double-walled design of the controlling collar on the pressure side of the controlling collar leads to the provision of an additional pressure chamber between the two walls forming the double wall, which is situated radially outside the region (pressure space) swept by the rotor vanes, while radial openings in the wall facing the vane cells establish communication between the pressure space and the pressure chamber. The pressure space is thereby emptied more easily and faster, so that, even if the rotor rotates at a very high speed, no excessively high pressure builds up and hard pressure shocks are avoided.

A disadvantage of this embodiment with a double-walled controlling collar and an additional pressure chamber on the pressure side of the controlling collar is the need of the controlling collar for additional space, so that the casing must be correspondingly larger.

Particularly in the last-mentioned embodiment with an additional pressure chamber on the controlling collar, the recess provided additionally according to the invention, does not make the controlling collar larger, or makes it only slightly larger, than it would be without the recess. The inner wall of such a recess can readily extend into the pressure chamber, because the pressure chamber need not have along the whole axial length of the controlling collar a uniform cross-section in order to fulfil its function.

In order to provide a recess in the pressure region, the wall of the controlling collar may be double-walled, in which case the recess is provided between the inner and an outer wall. In a controlling collar which, when an additional pressure chamber is made in the pressure region, has already been made double-walled, the outer wall of the controlling collar is itself made again double-walled, at least in a portion, to provide the corresponding recess.

In a preferred embodiment of the invention two hollows or recesses are provided on mutually opposite sides of the controlling collar, these hollows being open at least in the direction of displacement. The direction of displacement means the directions in which the adjustment member or members exerts a force onto the controlling collar. The two hollows are separated by a partition situated between them.

Two adjustment members can act opposite to each other on one such controlling collar, respond to the changing of the controlling collar position and the above-mentioned pumping parameters in a different way. In the case of a suitable choice a desired equilibrium state is established.

The mentioned recesses or hollows preferably have a cylindrical cross-sections because the adjustment members also have, in their simplest embodiment, mostly cylindrical cross-sections.

Particularly preferred is an embodiment of the invention in which the outer wall of the controlling collar in the pressure region, i.e. either the outer wall of the pressure space or, if available, the outer wall of a pressure chamber, provided additionally radially outside the pressure space, is itself made, at least in part, double-walled, while between the two parts forming the double wall is formed the desired recess for accommodation of the adjusting member.

Also preferred is the embodiment according to the invention in which in one of the recesses is situated an adjustment piston impinged upon by pressure. It has been found to be particularly useful in such an embodiment if the adjustment piston is guided in a leakproof manner in a correspondingly shaped recess and if further an opening is made in the wall delimiting inwardly the recess, which establishes communication with the pressure chamber or pressure space of the pump. This opening is expediently provided at the inner end of the recess. When impinged by pressure, the piston is forced out of the recess and bears with its end projecting from the recess for instance on the inner wall of the pump casing. The pressure medium in that case exerts a corresponding reaction force on the end wall of the recess facing away from the piston, whereby the controlling collar is moved away from the wall of the casing on which the piston presses.

The counterforce needed in these circumstances to keep the controlling collar in an equilibrium position, is advantageously provided by the compression spring which is situated in a recess opposite to the first recess and which bears with its end projecting from the recess on the opposite wall of the casing. In this embodiment of the device it is advantageous for the end of the piston projecting from the first-mentioned recess to be provided with a rounded end face and when, for instance, the compression spring, made as a helical spring, to be provided at its end projecting from the recess, with a cap which has a correspondingly round and slidable surface. During the movement of the controlling collar, these surfaces of the pistons and compression springs engaging with the walls may more easily slide without leaving traces of wear.

Particularly advantageous is an embodiment of the invention in which the inner wall of the casing is lined with a sheet insert of spring steel which offers to the ends of the adjustment members engaging with it an engagement surface which is substantially non-wearing or at least has a very low rate of wear.

Finally preferred is an embodiment of the invention in which the controlling collar is swingably suspended at its side facing away from the adjustment members. In that embodiment a single pair of eccentrically situated adjustment members is sufficient. These adjustment members, of course, during the swingable displacement of the controlling collar necessarily perform also movements perpendicular to the path of adjustment, so that then the earlier mentioned embodiments, which have on the ends of the adjustment members and their engagement regions slidable surfaces which are non-wearing or have a low rate of wear, are particularly advantageous.

BRIEF DESCRIPTION OF THE DRAWINGS

Further advantages, features and possible applications of the present invention will be apparent from the following description and accompanying drawing, in which.

SPECIFIC DESCRIPTION

Figure 2:
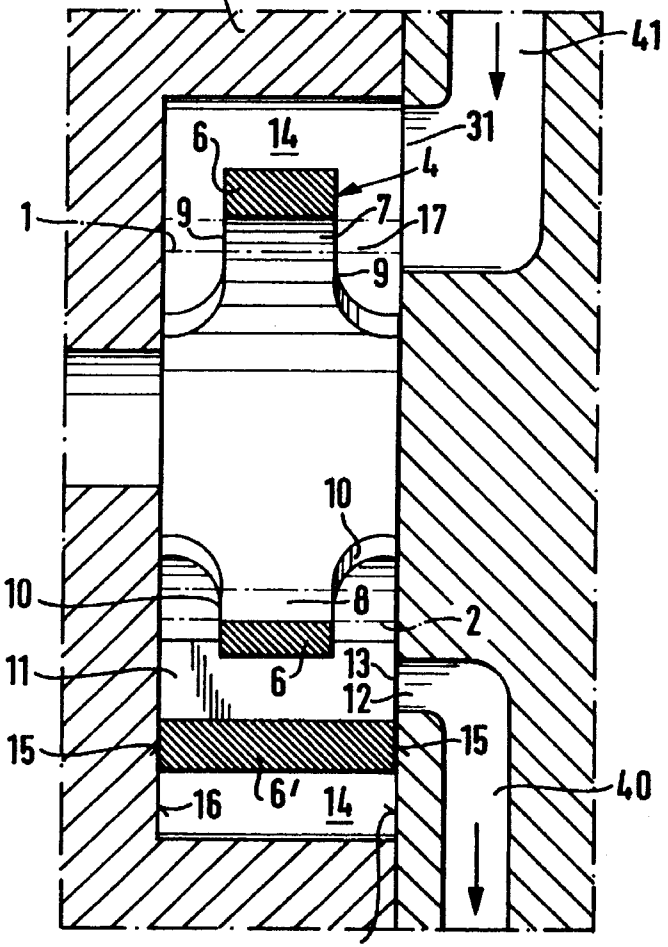
Fig. 2 PRIOR ART
FIGS. 1 and 2 are two mutually perpendicular sectional views of a prior art vane pump.

The essential functions of the pump will be briefly described with reference to the state of the art according to FIGS. 1 and 2. A casing 3 has an interior 14 receiving a rotor 1 which rotates on a shaft 1' and has radially and axially extending guiding slots 2' for vanes 2. The vanes are resiliently prestressed from the center of the rotor 1 and are thereby pressed outwardly in a radial direction. The rotor 1 is surrounded, with a spacing, by a substantially cylindrical inner wall of a controlling collar 4. The hatched areas of the controlling collar 4 in FIG. 1 bear upon the planar surface 16 of the casing 3, as is apparent from FIG. 2. The controlling collar is substantially mirror-symmetrical so that on the opposite side, mirror-image-fashion, identical areas of the controlling collar 4 bear upon the casing. As can also be seen from FIG. 2 the controlling collar has also in the radial direction openings 9 and 10 for flowing of the pumped medium in and out. The pumped medium flows through the bore 41 in the casing into the space 14 surrounding the controlling collar 4, and partly also directly into the region 17 of the suction space swept by the vanes cells.

Figure 1:
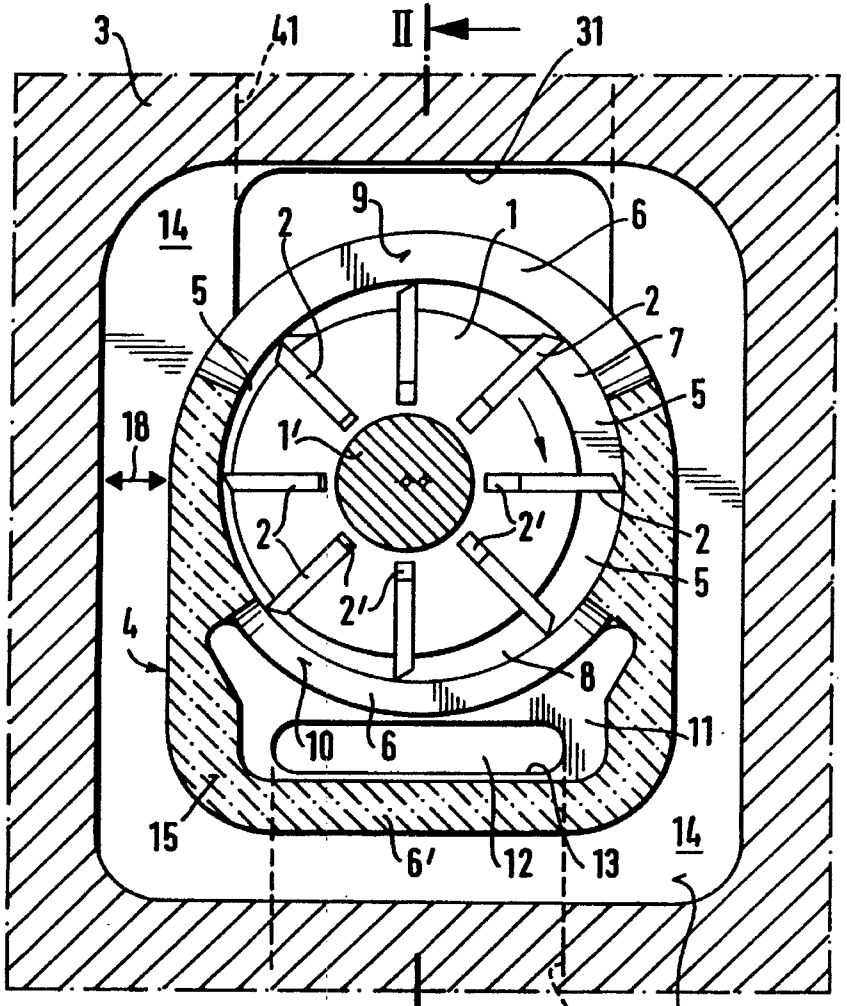
Fig. 1 PRIOR ART

As is easily seen from FIG. 1, the vanes 2 and the vane cells 5 defined between adjacent vanes 2 take the pumped medium from the suction space 7 and discharge it in the pressure space 8, because in the pressure region the volume of the vane cells 5 between the rotor and the lower wall 6 of the controlling collar 4 decreases. The pumped medium flows out through openings 10 in radial direction and flows into the pressure chamber 11 and from there through the axial opening 12 into the bore 40 on the pressure side of the casing 3. It will be understood that the mouth 13 of the bore 40 could also be situated in the region of the pressure space 8 and the wall 6 could bear in the pressure region of the controlling collar upon the walls 16 of the casing 3, so that the vane cells could be emptied in axial direction into a correspondingly shaped mouth 13 (see FIG. 7).

The double headed arrow 18 in FIG. 1 indicates the possibility of displacement of the controlling collar 4. If the controlling collar 4 in FIG. 1 is positioned more to the left, the vane cell volume changes, during sweeping of the suction space 7 or also the pressure space 8, less than in the state illustrated in FIG. 1. As a consequence, less medium is pumped so that, assuming a constant requirement on the pressure side, the pressure in the pressure region decreases. In FIGS. 1 and 2 are not shown the corresponding adjustment members which perform the displacement of the controlling collar relative to the rotor 1 and casing 3 and thereby control the pumping volume and pressure. Generally pistons and springs acting against each other are used as the adjustment members, a corresponding piston being in general guided in the casing and impinged from the side of the casing by the pumped medium which is branched of from the pressure side, e.g. from the bore 40.

Figure 4:
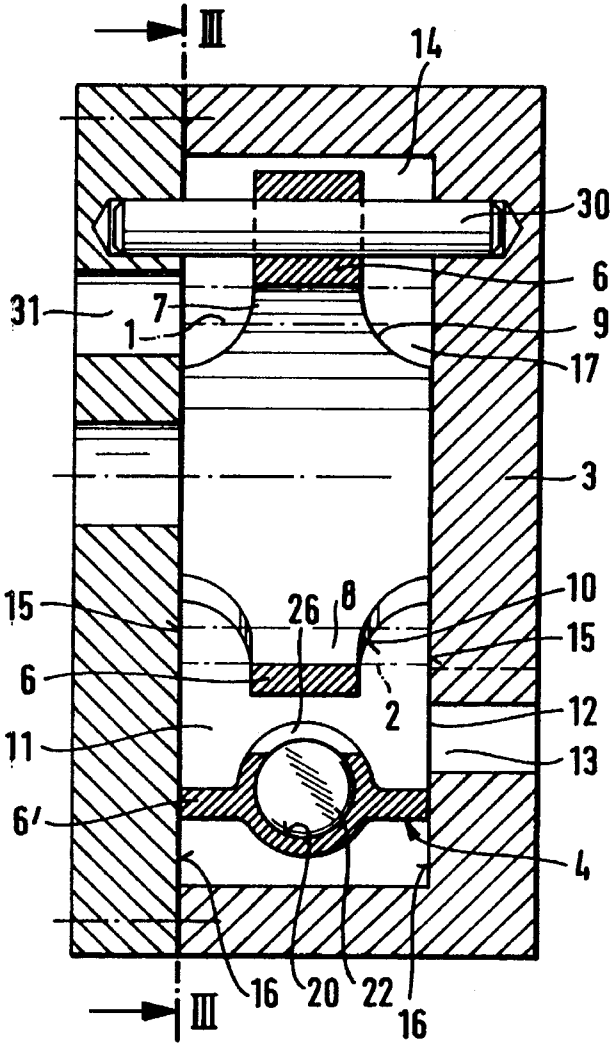
FIGS. 3 and 4 are sections, corresponding to FIGS. 1 and 2, of a preferred embodiment of a vane pump according to the invention.
Figure 3:
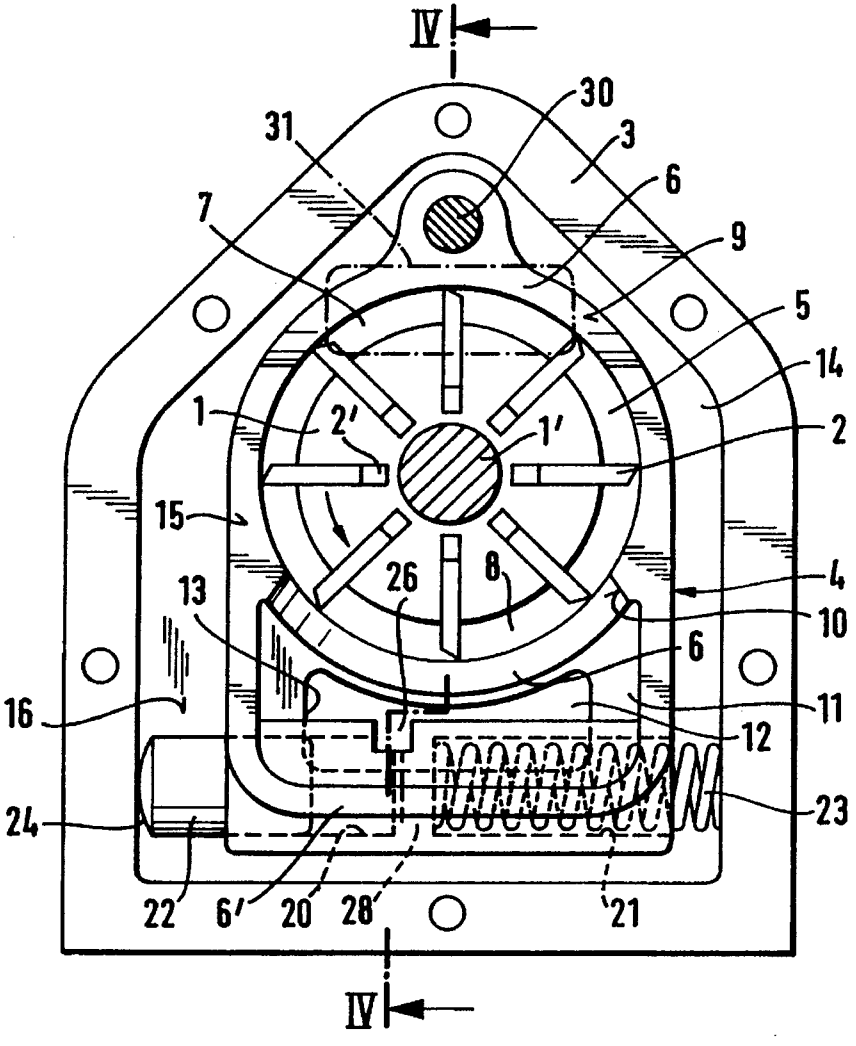

Several pistons can displace the collar in parallel or the collar may be suspended swingably about an axis as is shown in connection with this pump design according to the invention in FIGS. 3 and 4.

From FIGS. 3 to 7 is apparent that the controlling collar is mounted swingably about a shaft 30 situated in the upper part of the casing. In contrast to the embodiment in FIG. 1, which does not show the adjustment members but shows the displacement possibility of the controlling collar 4, the adjustment members 22, 23 are so arranged that, the pumped volume decreases when the controlling collar is swung from left to right and increases when it is swung from right to left. In principle the vane pump shown in FIGS. 1 and 2 functions in the same way as the vane pumps shown in FIGS. 3 to 6.

The particular features of the new vane pumps reside in the recesses 20, 21 situated in the lower portion, i.e. in the pressure region, of the controlling collar. In all the embodiments illustrated in FIGS. 3 to 6 the controlling collar 4 in the pressure region is made double-walled while forming an additional pressure chamber 11. The pressure chamber 11 is situated between the inner wall 6 and the outer wall 6' of the controlling collar. The outer wall 6' is itself in its central part double-walled. Two cylindrical hollows 20, 21, open towards opposite sides and separated by a partition 28, are shown, of which the hollow or recess 20 receives a piston 22 which is leaktightly guided in the recess, while the hollow 21 accommodates a helical compression spring 23. The two hollows 20, 21 are open in opposite directions, the extension of the hollows 20, 21, defined in this way, from the closed to the open end or vice versa defining the direction of displacement, which must always extend transversely to the axis of the rotor 1 (which is not shown in FIGS. 3 to 6) and has at any case a radial component with respect to the rotor 1, because the vane cell volume is defined by the radial spacing between the surface of the rotor and the inner surface of the controlling collar 4.

During pumping the pumped medium flows from the pressure space 8 first in radial direction into the pressure chamber 11 and from there, through the axially extending opening 12 of the pressure chamber 11, into the mouth 13 of the bore 40 in the casing. The arching of the inward wall of the hollows 20, 21 into this pressure space 11 impedes the flow of the pumped medium only insignificantly because the free cross-sectional area between the wall 6 and the inner wall of the recesses 20, 21 can be readily kept greater than the cross-sectional area of the bore 40 in the casing 3.

Figure 5:
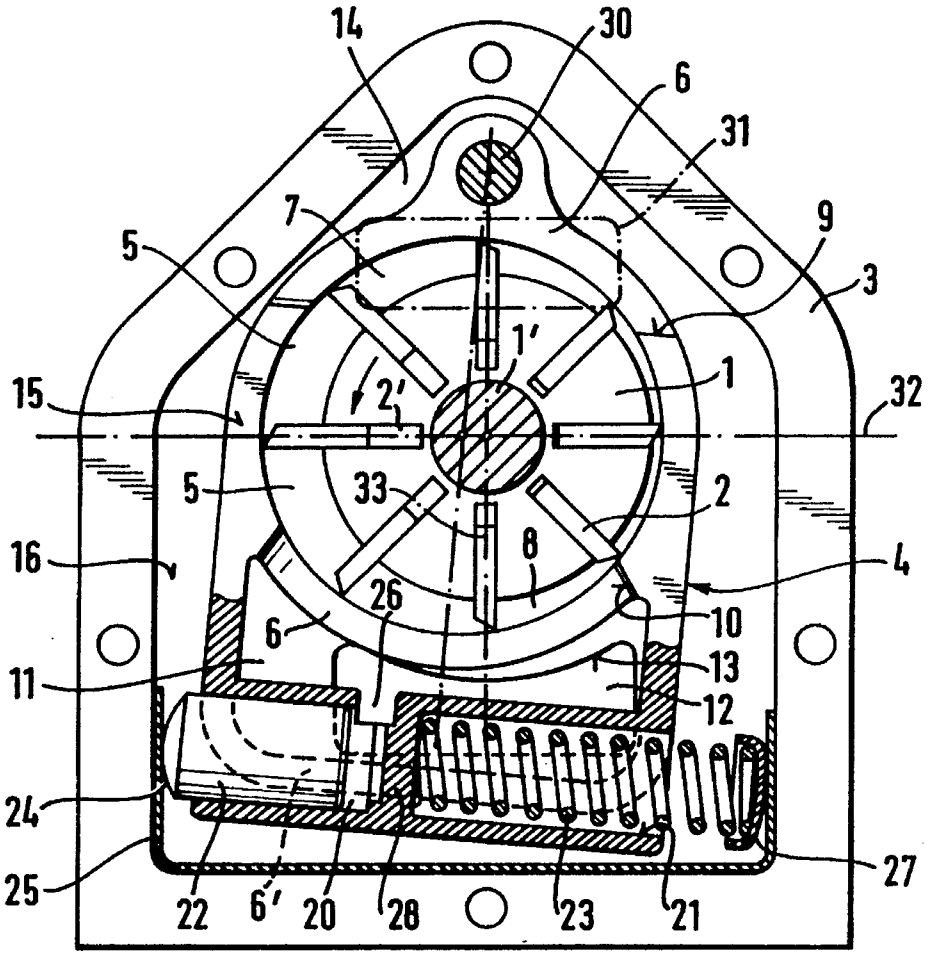

In the illustrated preferred embodiments in FIGS. 3 to 6 there is also an opening 26 in the wall of the recess 20 leading to the pressure chamber 11. Through this opening 26 the pumped medium passes into the hollow 20 and impinges onto the piston 22 from inside with pressure. The embodiments shown in FIGS. 3 and 5 differ from each other substantially only by the sheet 25 of spring steel, inserted in FIG. 5 into the casing 3, and the cap 27 of the compression spring 23. FIG. 5 shows, in addition, the state of the pump at which a relatively large quantity of the pumped medium is pumped at a relatively low pressure; the controlling collar is in a position of nearly maximum deflection to the left and thereby maximum eccentricity with respect to the rotor 1 (not shown) whose center may, however, be imagined e.g. at the point of intersection of the dash-and-dot lines 32, 33. If, for instance, the demand for the pumped medium on the pressure side is smaller, the pressure will, at the given pumped volume, increase, which causes the piston 22 under pressure applied to the inner wall of the recess 20 opposite the end face 24 of the piston, to react and swing the collar to the right. As a consequence, the controlling collar 4 is swung more in the direction of the position shown in FIG. 3, until the counterforce exercised by the compression spring 23, which is in those circumstances further compressed, exactly compensates the force exercised by the piston due to the greater pressure. The pumping volume now decreases so that the pressure also drops. As a result, an equilibrium state is established between the two extreme positions which are illustrated in FIGS. 3 and 5, while in FIG. 3 the rotor is imagined as being centrally positioned in the controlling collar 4 (pumping output zero) and in FIG. 5 the position of maximum eccentricity is arrived at (maximum pumping output).

In the embodiments according to the invention the shape of the casing is substantially simpler than in prior art pumps in which piston guides and particularly also bores or ducts, which supply medium under pressure to the piston, were needed.

Also the compression spring need not be mounted in the casing. All the corresponding components are instead arranged on the controlling collar, which at any case and particularly in the example of the double-walled arrangement with a pressure chamber 11 requires a certain volume, that is not notably increased by the additional accommodation recesses for the controlling collar.

The casing 3 can therefore be made altogether much simpler and more compact.

As is apparent on comparison of the two FIGS. 3 and 5, the ends of the piston 22 and the compression spring 23, which project from the recesses 20 and 21, must also slide on the adjacent inner surfaces of the casing 3. The piston has, appropriately, for this purpose a preferably spherically rounded end face 24 and the compression spring 23 is provided with a cap 27 the outer surface of which is also rounded. In addition the inner surface of the casing 3 is, in the region where the piston 22 or its end face 24 and the cap 27 of the compression spring 23 are in contact with the inner surface of the casing, lined with a sheet 25 of spring steel. The materials of the cap 27 and the end face 24 of the piston 22 are preferably so selected that they easily slide on the spring steel of the sheet 25. The sheet 25 of spring steel is preferably inserted in one piece in the lower portion of the casing 3 and may be firmly clamped by the ends below corresponding extensions or a shoulder on the inner wall of the casing 3. This insertion of the sheet 25 of spring steel in one piece simplifies assembly and reduces production cost.

Figure 6:
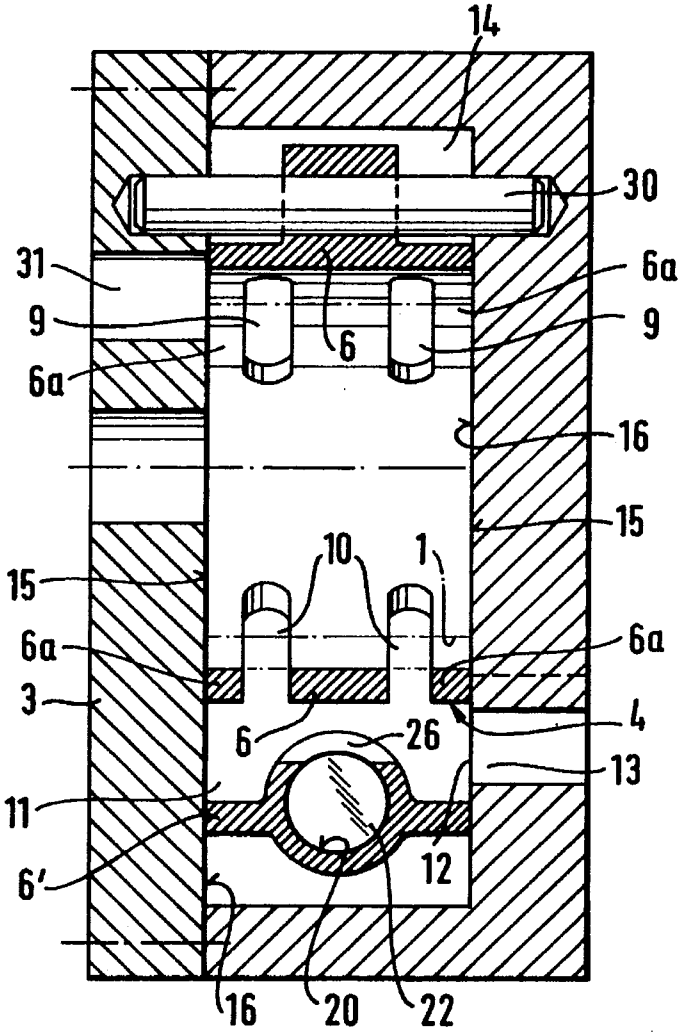
FIGS. 5 and 6 are corresponding sections which show additional features and modifications of the embodiments shown in FIGS. 3 and 4 in corresponding sections.

FIG. 6 shows in an axial section through the casing and controlling collar, only one variant in the design of the openings 10 between the pressure space and pressure chamber, which are represented in the example of FIG. 6 as two parallel slots extending in peripheral direction, where on the axial ends of the controlling collar 4 still remain portions **6*a* of the wall 6 of the controlling collar. In contrast to this, in the embodiment according to FIG. 4 a wall portion 6 remains only in the central region, both on the pressure side and the suction side, the wall portion serving as a guide for the vanes 2**.

Compared to the prior art shown in FIG. 2, the embodiments of FIGS. 4 and 6 differ also in that the suction-side openings 31 are provided in the casing wall which is situated opposite to the casing wall in which are provided the pressure-side openings 13.

Also this is, however, no essential feature of the invention. On the contrary, it may be more useful if both the openings are situated on one side of the casing, particularly if, as shown in FIGS. 4 and 6, the casing is formed by a hollow, which is open substantially on one side and which after mounting of the rotor and controlling collar is only provided with a wall or cover closing the open side of the casing.

The invention includes also embodiments in which the controlling collar 4 is fully closed along its periphery and flowing of the pumped medium into the vane cells between the rotor and the controlling collar and out of them, is possible only in the axial direction. To this end only the suction-side opening 31 and the pressure-side opening 13 must be provided in the region of the vane cells 5. The recesses 20 and 21 may then be formed by a double-wall arrangement of the lower wall 6 of the controlling collar 4. Such an embodiment is shown in FIGS. 7 and 8.

Figure 8:
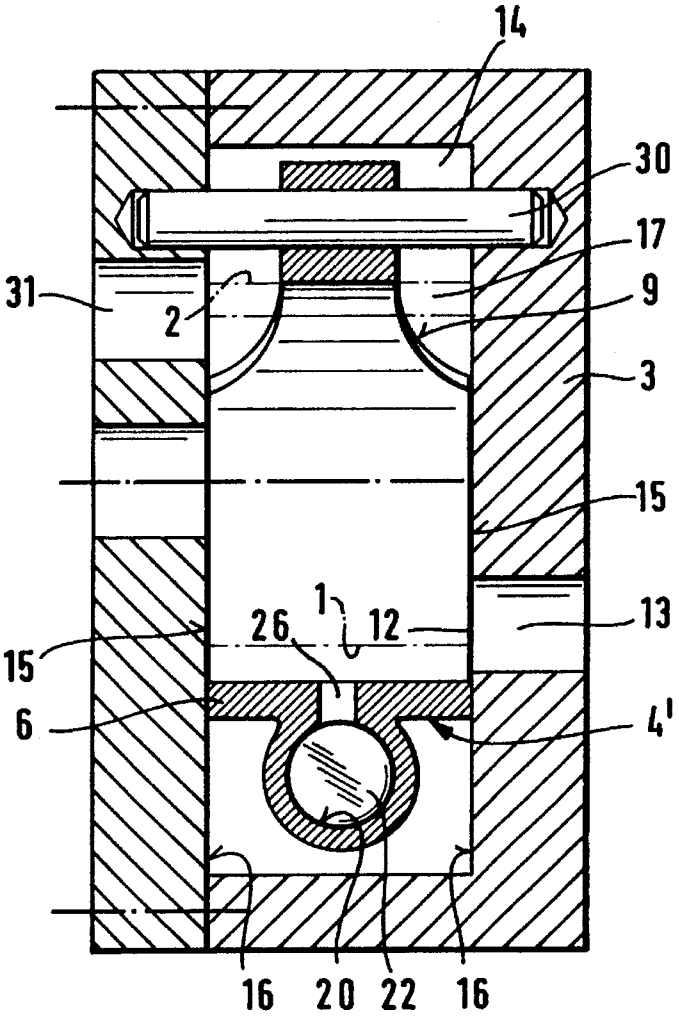
FIGS. 7 and 8 are sections through a further embodiment without a radial pressure chamber.
Figure 7:
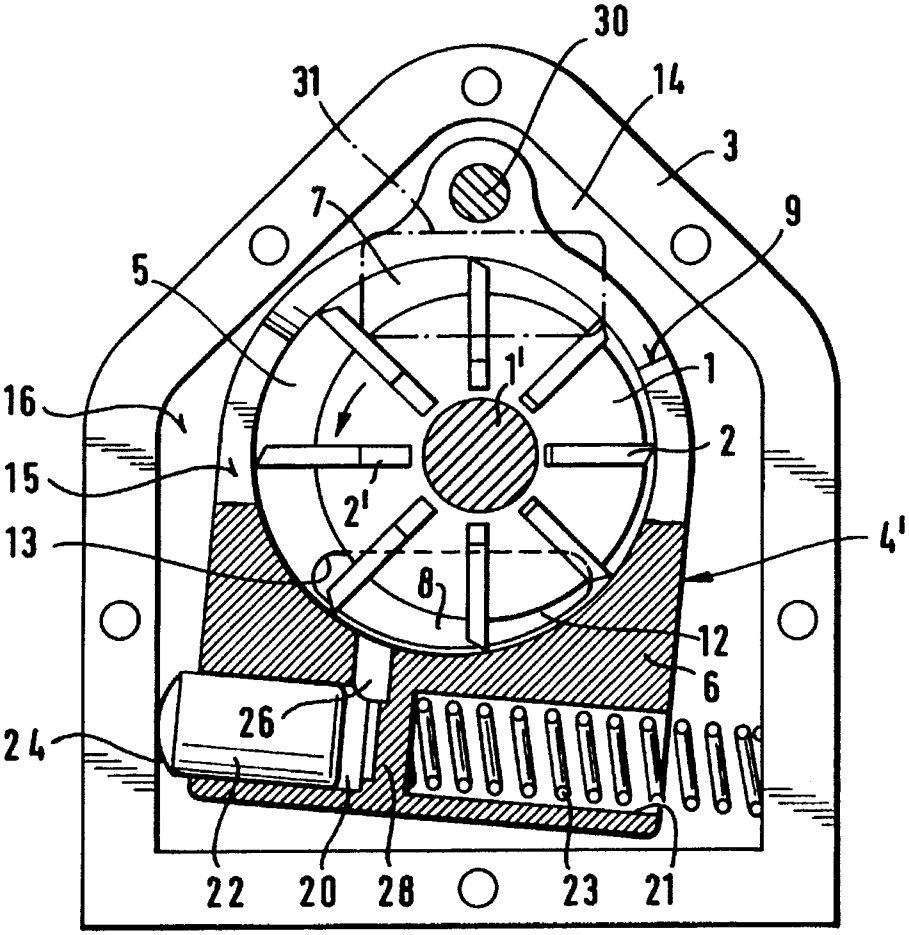

In FIGS. 7 and 8 show a vane pump comprising a simpler controlling collar 4' which has no pressure chamber situated radially outside the pressure space 8, so that the inner wall 6 and the outer wall 6' of the earlier described embodiments coincide. Nonetheless, two substantially aligned cylindrical hollows 20 and 21 are provided on the lower side of the controlling collar 4', the hollows extending approximately tangentially along the outer side of the controlling collar 4' at its end opposite to the suspension. The cylindrical hollow 20 communicates, through an opening 26, with the pressure space inside the controlling collar 4', and the piston 22 is leaktightly guided in the hollow 20 so that when the pressure increases the piston is pushed out of the cylindrical hollow 20, bears onto the inner wall of the casing 3 and, due to the reaction force, pushes the controlling collar 4' in the direction of smaller eccentricity. In the opposite hollow 21 is again situated a spring 23 which exerts a corresponding counterforce so that equilibrium is established between the spring force and the pump pressure. When such a pump is manufactured the lower hollows 20, 21 may either be directly formed or co-cast, but the controlling collar may also be first made separately, whereupon a pipe, closed in the middle, is simply welded onto the lower side of the controlling collar 4', after the opening 26, e.g. in the form of a bore, has been made. In the cross-sectional representation according to FIG. 7 the controlling collar 4' need not extend with its maximum (horizontal) diameter up to the region of the hollows 20, 21, rather the outer surface of the controlling collar 4' may extend parallel to its inner surface circularly close over a tubular shoulder which forms the mentioned hollows 20, 21.

The vane pump according to the invention is relatively inexpensive and may be made primarily to have a small weight and small dimensions. The somewhat more expensive design of the controlling collar is readily made up for by corresponding savings in the design of the casing so that on the whole the advantageous properties of the new vane pump predominate.

I claim:

1. A vane pump comprising:

a vane-pump casing;

a rotor rotatable mounted in said casing for rotation about an axis and having outwardly biased vanes thereon;

a control collar mounted in said casing for movement transverse to said axis and surrounding said rotor whereby said vanes engage a surface of said collar and define cells therewith decreasing in volume toward a pressure region upon rotation of said rotor relative to said collar, said collar being formed with at least one recess exposed to pressure in said region and open toward an exterior of said collar;

an adjustment member in said recess biased by pressure therein and reacting against said casing to adjust a position of said control collar in dependence upon a pumping parameter; and a lining of a wear resistant material extending in said casing in a region where said casing is engaged by said adjustment member.

2. The vane pump defined in claim 1 wherein said wear resistant material is a sheet of spring steel.

3. The vane pump defined in claim 1 wherein said collar is swingably mounted in said casing at a side of said collar opposite that at which said recess is provided.

4. The vane pump defined in claim 1 wherein a second recess is provided in said collar opposite the first-mentioned recess, said member is a piston in said first-mentioned recess and said vane pump further comprises a compression spring in said second recess and bearing on said sheet.

5. The vane pump defined in claim 4 wherein said compression spring is provided with a slide cap bearing upon said sheet.

6. The vane pump defined in claim 5 wherein said piston has a rounded end bearing on said sheet.

7. A vane pump comprising:

a vane-pump casing;

a rotor rotatable mounted in said casing for rotation about an axis and having outwardly biased vanes thereon;

a control collar mounted in said casing for movement transverse to said axis and surrounding said rotor whereby said vanes engage a surface of said collar and define cells therewith decreasing in volume toward a pressure region upon rotation of said rotor relative to said collar, said collar being of a double-wall structure defining a pressure chamber between inner and outer walls thereof in said pressure region, said pressure chamber communicating with said pressure region through radial openings in said inner wall, said outer wall being of a double-wall configuration formed with at least one recess exposed to pressure in said region and open toward an exterior of said collar; and an adjustment member in said recess biased by pressure therein and reacting against said casing to adjust a position of said control collar in dependence upon a pumping parameter.

8. The vane pump defined in claim 7, further comprising a lining of a wear resistant material extending in said casing in a region where said casing is engaged by said adjustment member.

9. The vane pump defined in claim 8 wherein said wear resistant material is a sheet of spring steel.

10. The vane pump defined in claim 7 wherein said collar is swingably mounted in said casing at a side of said collar opposite that at which said recess is provided.

11. The vane pump defined in claim 7 wherein a second recess is provided in said outer wall opposite the first-mentioned recess, said member is a piston in said first-mentioned recess and said vane pump further comprises a compression spring in said second recess and bearing on said casing.

12. The vane pump defined in claim 11 wherein said compression spring is provided with a slide cap bearing upon said sheet.

13. The vane pump defined in claim 11 wherein said piston has a rounded end bearing on said casing.

* * * * *